US010730288B2

(12) United States Patent
Akiyama et al.

(10) Patent No.: US 10,730,288 B2
(45) Date of Patent: Aug. 4, 2020

(54) LIQUID DISCHARGE HEAD, LIQUID DISCHARGE DEVICE, AND LIQUID DISCHARGE APPARATUS

(71) Applicants: Kohta Akiyama, Kanagawa (JP); Noriyasu Takeuchi, Kanagawa (JP)

(72) Inventors: Kohta Akiyama, Kanagawa (JP); Noriyasu Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/149,189

(22) Filed: Oct. 2, 2018

(65) Prior Publication Data

US 2019/0217607 A1 Jul. 18, 2019

(30) Foreign Application Priority Data

Jan. 15, 2018 (JP) ..... 2018-004023

(51) Int. Cl.
*B41J 2/045* (2006.01)
*B41J 2/14* (2006.01)

(52) U.S. Cl.
CPC ..... *B41J 2/04563* (2013.01); *B41J 2/04581* (2013.01); *B41J 2/14274* (2013.01); *B41J 2002/14419* (2013.01); *B41J 2002/14491* (2013.01); *B41J 2202/08* (2013.01)

(58) Field of Classification Search
CPC ..... B41J 2/04563; B41J 2/14274; B41J 2/04581; B41J 2002/14491; B41J 2002/14419; B41J 2202/08
See application file for complete search history.

(56) References Cited

U.S. PATENT DOCUMENTS

2012/0242739 A1* 9/2012 Owaki ..... B41J 2/04563 347/17
2013/0215173 A1 8/2013 Akiyama
2013/0241986 A1 9/2013 Aoki et al.
2013/0323474 A1 12/2013 Gotou et al.
2014/0191062 A1* 7/2014 Sasagawa ..... B41J 2/14209 239/75
2015/0062255 A1 3/2015 Sasaki
2016/0082728 A1 3/2016 Kohda et al.
2016/0144620 A1 5/2016 Masuda et al.
2016/0297193 A1* 10/2016 Yoshida ..... B41J 2/14274
(Continued)

FOREIGN PATENT DOCUMENTS

JP 2004-322411 11/2004
JP 2010-214655 9/2010
(Continued)

*Primary Examiner* — Yaovi M Ameh
(74) *Attorney, Agent, or Firm* — Oblon, McClelland, Maier & Neustadt, L.L.P.

(57) ABSTRACT

A liquid discharge head includes a plurality of individual chambers communicating with a plurality of nozzles that discharges a liquid, a common chamber formed by a frame and communicating with the plurality of individual chambers, a temperature detector to detect temperature of the liquid, and a temperature controller connected to the temperature detector, to heat or cool the liquid in the common chamber based on readings from the temperature detector. The temperature detector is disposed opposite the common chamber across the plurality of individual chambers in a direction perpendicular to a direction of liquid discharge from the plurality of nozzles.

10 Claims, 9 Drawing Sheets

(56) References Cited

U.S. PATENT DOCUMENTS

| | | | |
|---|---|---|---|
| 2016/0325550 | A1 | 11/2016 | Masaoka et al. |
| 2016/0347055 | A1* | 12/2016 | Yamaguchi ..... B41J 2/1433 |
| 2017/0087865 | A1 | 3/2017 | Yoshida et al. |
| 2017/0157924 | A1 | 6/2017 | Otome et al. |
| 2017/0326874 | A1 | 11/2017 | Akiyama |

FOREIGN PATENT DOCUMENTS

| | | |
|---|---|---|
| JP | 2010-241100 | 10/2010 |
| JP | 2012-171319 | 9/2012 |
| JP | 2016-198989 | 12/2016 |
| JP | 2017-061114 | 3/2017 |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-004023, filed on Jan. 15, 2018 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

In a liquid discharge head that discharges a liquid, discharge characteristics change due to a change in viscosity of the liquid to be discharged, for example.

There is an image recording apparatus that includes an ink channel in each of ink tanks, recording heads, and supply tubes. The image recording apparatus further includes a hot water channel that circulates hot water in a vicinity of at least a part of the ink channel and temperature sensors that detect temperature of the ink in the ink channels. The temperature sensors are provided in at least two places in the ink channels. The image recording apparatus controls at least one of the temperature and a flow rate of the hot water circulated in the hot water channel according to a difference in the temperature detected by the temperature sensors.

SUMMARY

In an aspect of this disclosure, a liquid discharge head includes a plurality of individual chambers communicating with a plurality of nozzles that discharges a liquid, a common chamber formed by a frame and communicating with the plurality of individual chambers, a temperature detector to detect temperature of the liquid, and a temperature controller connected to the temperature detector, to heat or cool the liquid in the common chamber based on readings from the temperature detector. The temperature detector is disposed opposite the common chamber across the plurality of individual chambers in a direction perpendicular to a direction of liquid discharge from the plurality of nozzles.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
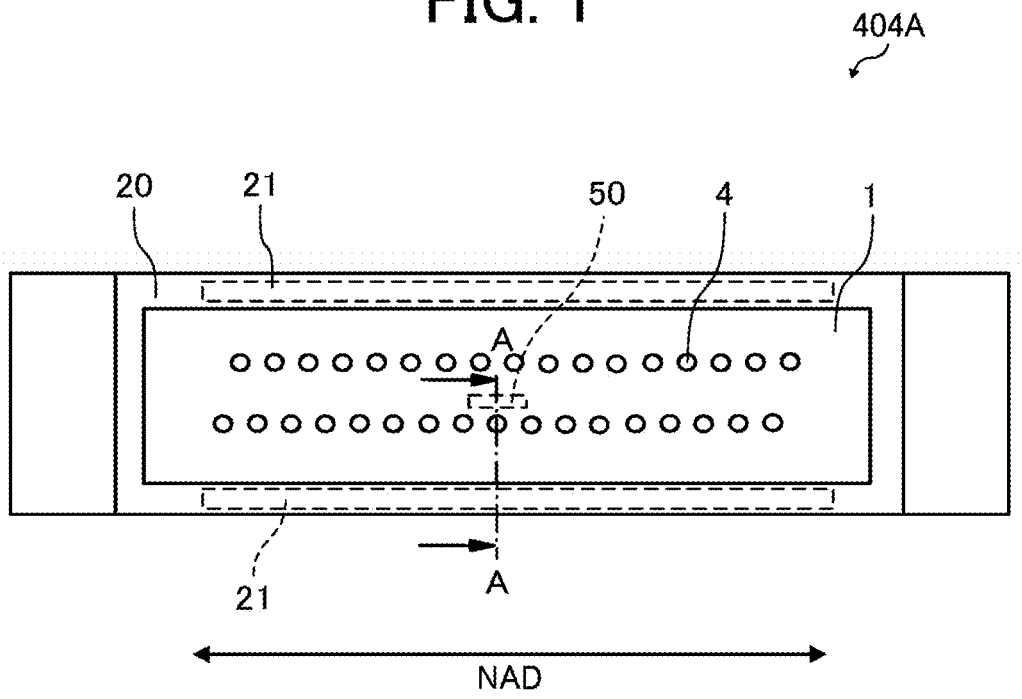
FIG. 1 is a plan view of the liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Figure 2:
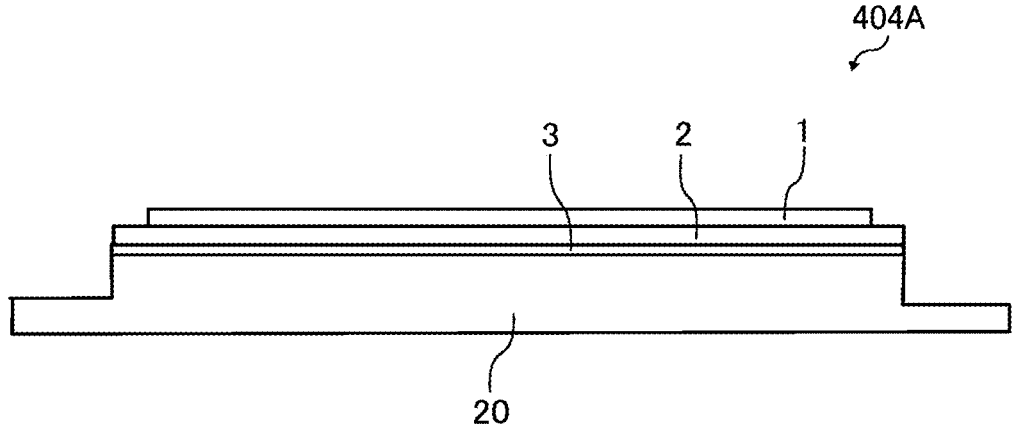
FIG. 2 is a side view of the liquid discharge head of FIG. 1.
Figure 3:
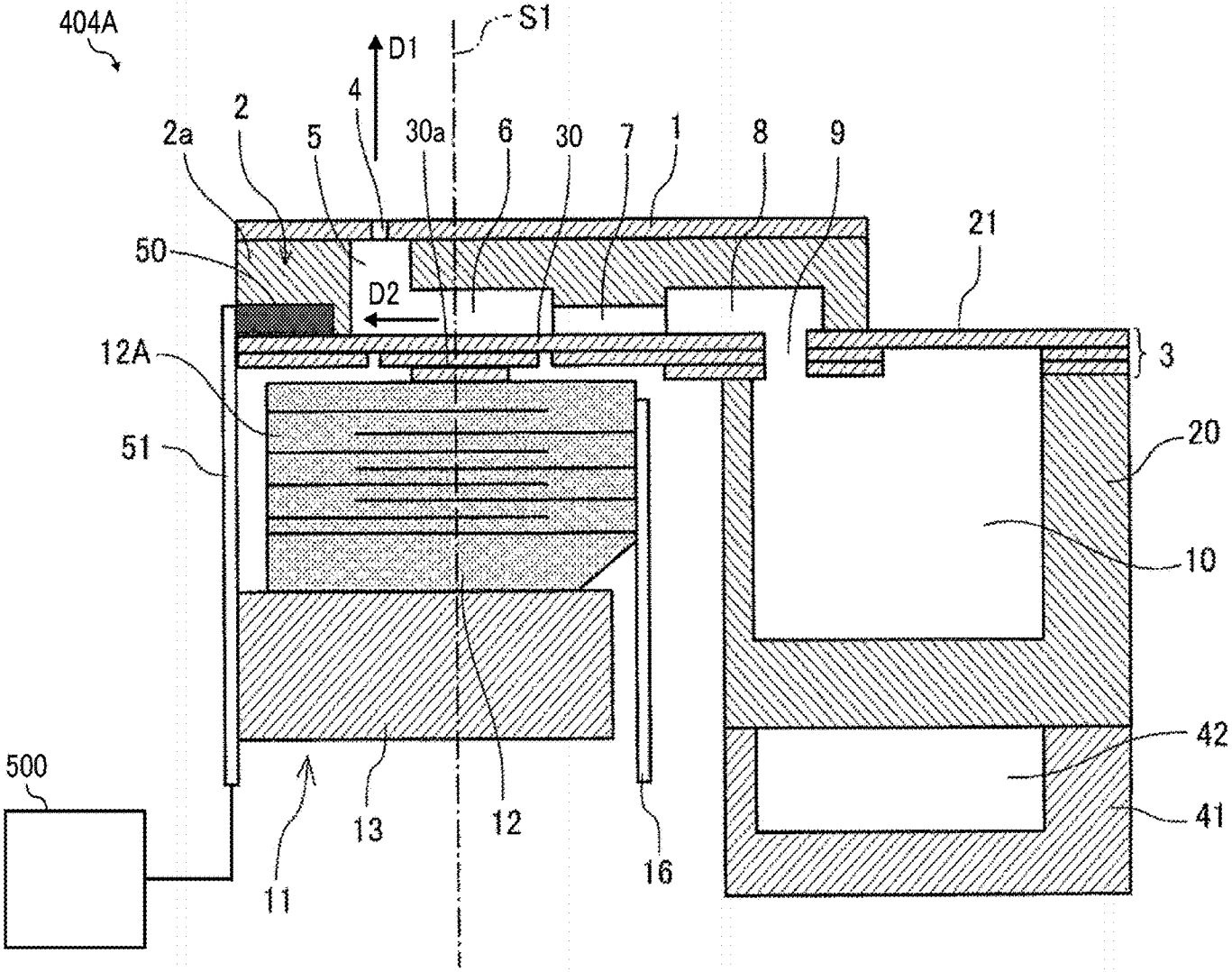
FIG. 3 is a cross-sectional view of the liquid discharge head along a line A-A indicated in FIG. 1 in a direction perpendicular to a nozzle array direction in which nozzles are arrayed in row.
Figure 4:
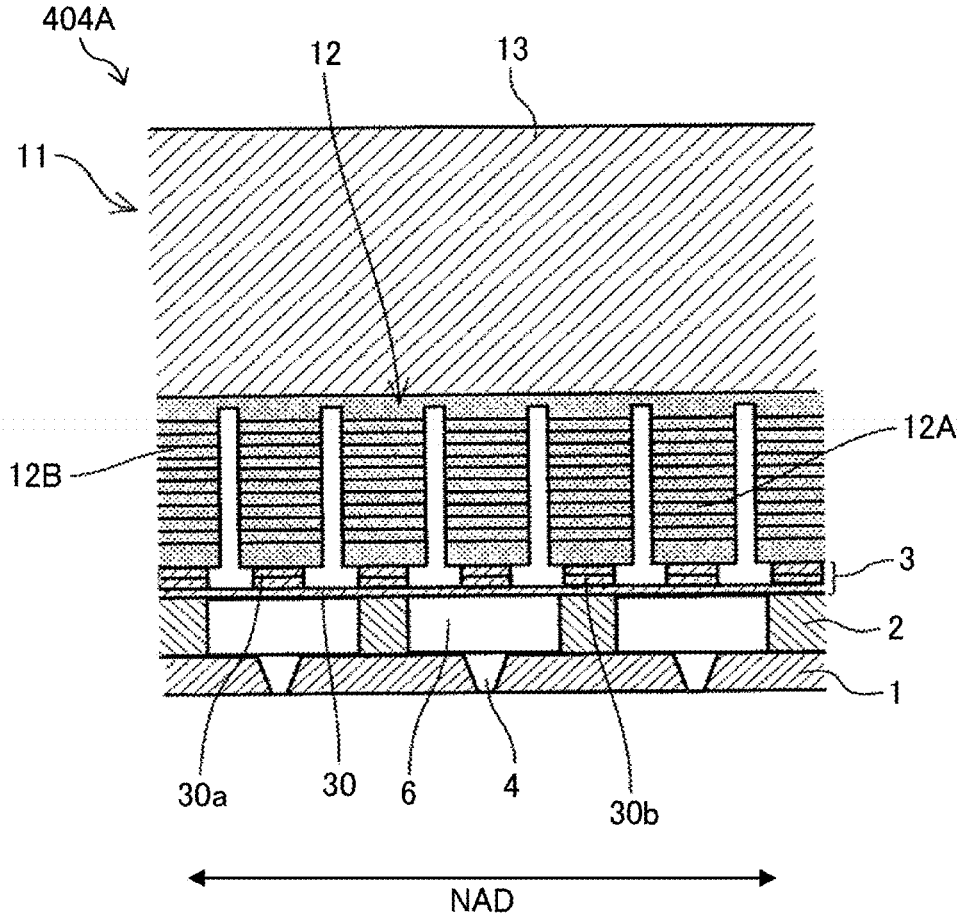
FIG. 4 is a cross-sectional view of the liquid discharge head in the nozzle array direction.

A first embodiment of the present disclosure is described with reference to FIGS. 1 through 4. FIG. 1 is a plan view of a liquid discharge head 404A according to the first embodiment of the present disclosure. FIG. 2 is a side view of the liquid discharge head 404A according to the first embodiment of the present disclosure. FIG. 3 is a cross-sectional view of the liquid discharge head 404A along a line A-A indicated in FIG. 1 in a direction perpendicular to a nozzle array direction in which nozzles 4 are arrayed in row. FIG. 4 is a cross-sectional view of the liquid discharge head 404A of FIG. 3 in the nozzle array direction (a transverse direction of the individual chamber). The nozzle array direction is indicated by NAD in FIGS. 1 and 4.

The liquid discharge head 404A according to the first embodiment of the present disclosure includes a nozzle plate 1, a channel plate 2, and a diaphragm member 3 serving as a wall member, laminated one on another and bonded to each other. (Hereinafter, the "liquid discharge head" is simply referred to as the "head".) The head 404A further includes a piezoelectric actuator 11 to displace vibrating portions 30 (diaphragms) of the diaphragm member 3, and a common-chamber member 20 also serving as a frame of the head 404A.

As illustrated in FIG. 1, the nozzle plate 1 includes two rows of nozzle arrays in each of which the nozzles 4 are arranged. The liquid is discharged from the nozzles 4.

The channel plate 2 includes through-holes and grooves that constitute nozzle communication channels 5 communicated with the nozzles 4, individual chambers 6 communicated with the nozzles 4 via the nozzle communication channels 5, fluid restrictors 7 communicated with the individual chambers 6, respectively, and one or more liquid introduction portions 8 communicated with the fluid restrictors 7.

The diaphragm member 3 includes the deformable vibrating portions 30 constituting walls of the individual chambers 6 of the channel plate 2. In the present embodiment, the diaphragm member 3 has a triple-layer structure including a first layer including thin portions and facing the channel plate 2, and a second layer and third layer including thick portions. The first layer includes the deformable vibrating portions 30 at positions corresponding to the individual chambers 6. Note that the diaphragm member 3 is not limited to the triple-layer structure described above but may have any other suitable number of layers.

The piezoelectric actuator 11 includes electromechanical transducer elements as driving devices (actuator devices or pressure generators) to deform the vibrating portions 30 of the diaphragm member 3. The piezoelectric actuator 11 is disposed at a first side of the diaphragm member 3 opposite a second side facing the individual chambers 6 (see FIG. 3).

The piezoelectric actuator 11 includes a piezoelectric member 12 bonded to a base 13. The piezoelectric member 12 is groove-processed by half cut dicing so that the piezoelectric member 12 includes a desired number of pillar-shaped piezoelectric elements 12A and 12B arranged at certain intervals in the shape of a comb (see FIG. 4).

The piezoelectric elements 12A are joined (bonded) to convex portions 30*a*, respectively. The convex portions 30*a* are thick portions having an island-like form formed on the vibrating portion 30 (diaphragm) of the diaphragm member 3. The piezoelectric elements 12B are joined (bonded) to the convex portions 30*b*, respectively. The convex portions 30*b* are thick portions of the diaphragm member 3.

The piezoelectric elements 12A and 12B include piezoelectric layers and internal electrodes alternately laminated on each other. Each internal electrode is extended to an end surface of the piezoelectric elements 12A and 12B to form an external electrode. The external electrode is connected to a flexible wiring member 16.

The common-chamber member 20 forms a common chamber 10 that communicates with the liquid introduction portion 8 via an opening 9 provided in the diaphragm member 3. Further, the common chamber 10 includes a damper portion 21 forming a wall of the common chamber 10.

In the head 404A, for example, when the voltage applied to the piezoelectric element 12A is lowered from a reference potential (intermediate potential), the piezoelectric element 12A contracts. As a result, the vibrating portion 30 of the diaphragm member 3 is pulled inward and the volume of the individual chambers 6 increases, thus causing liquid to flow into the individual chambers 6.

Conversely, when the voltage applied to the piezoelectric element 12A is raised, the piezoelectric element 12A expands in the direction of lamination. The vibrating portion 30 of the diaphragm member 3 is pushed in a direction toward the nozzle 4 and decreases the volume of the individual chambers 6. As a result, the liquid in the individual chambers 6 is squeezed out and discharged from the nozzle 4.

Note that the driving method of the head 404A is not limited to the above-described example (pull-push discharge). For example, pull-discharge or push-discharge may be performed in response to the way the drive waveform is applied.

Next, an arrangement of a temperature controller and a temperature detector in the head 404A according to the present embodiment is described below.

The head 404A of the present embodiment includes a temperature-control channel member 41 constituting the temperature controller is disposed on an outer surface of the common-chamber member 20. The temperature-control channel member 41 forms a temperature-control channel 42 through which a temperature-adjustment fluid communicates. The temperature-adjustment fluid adjusts temperature of the liquid in the common chamber 10 to be supplied to the individual chambers 6. The temperature-control channel 42 is disposed adjacent to the common chamber 10.

The temperature of the liquid in the common chamber 10 is controlled (adjusted) by heat conduction through the common-chamber member 20 by supplying the temperature-adjustment fluid for adjusting the temperature of the liquid in the common chamber 10 through the temperature-control channel 42. As the temperature adjusting fluid, for example, hot water or cold water may be used.

Thus, the head 404A according to the first embodiment can reduce fluctuation of the physical properties of the liquid and enable a stable liquid discharge even when the liquid, a viscosity or a surface tension of which varies depending on the temperature, is used as the liquid to be discharged, by suppressing a fluctuation of the temperature of the liquid.

The head 404A of the present embodiment includes a temperature detector 50 such as a thermistor for detecting the temperature of the liquid. The temperature detector 50 is provided in a wall portion 2*a* of the individual chamber 6. A lead wire 51 is connected to the temperature detector 50 and is further connected to a control section 500 (see FIG. 3).

The head 404A can apply a driving waveform to the piezoelectric elements 12A by measuring the temperature of the liquid. As a result, the head 404A according to the present embodiment can change (control) a discharge process according to the physical properties dictated by temperature even if the temperature of the liquid and thus the physical properties of the liquid fluctuate due to external and internal factors. Thus, the head 404A can stably and accurately discharge the liquid.

Here, the temperature detector 50 for detecting the temperature of the liquid is disposed in the vicinity of the individual chamber 6 and is disposed opposite the common chamber 10 such that the individual chamber 6 is sandwiched between the temperature detector 50 and the common chamber 10 in a direction perpendicular to a liquid discharge direction indicated by D1 in FIG. 3 (in a liquid flow direction D2). That is, the temperature detector 50 is disposed opposite the common chamber 10 across a line S1 in the liquid flow direction D2.

As a result, the temperature detector 50 is prevented from being influenced by the temperature of the temperature control fluid that flows through the temperature-control channel 42 of the temperature-control channel member 41. Thus, the temperature detector 50 of the head 404A can accurately detect the temperature of the liquid in the individual chamber 6.

Figure 5:
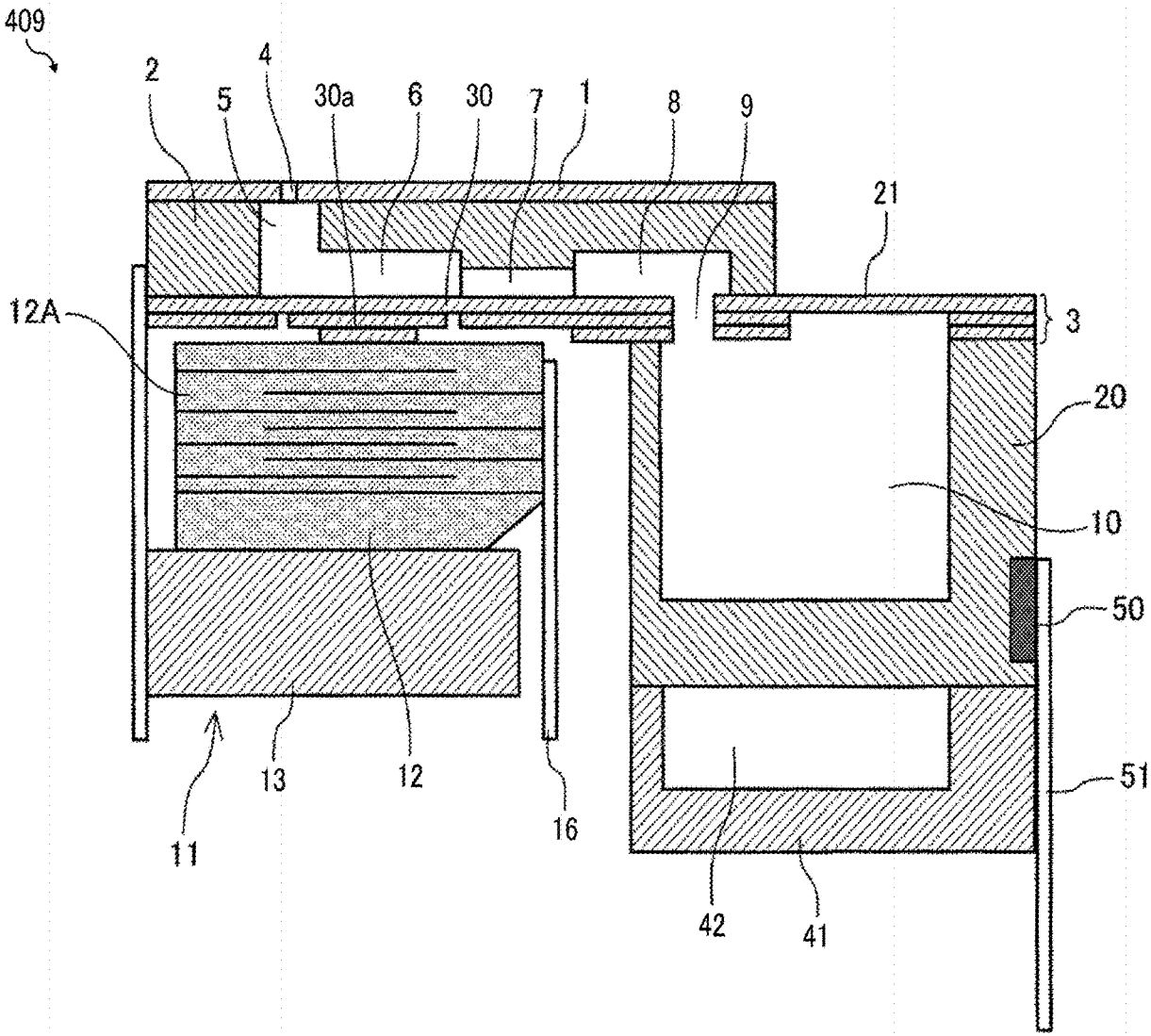
FIG. 5 is a cross-sectional view of the head according to a comparative example 1, in the direction perpendicular to the nozzle array direction.

This point is described with reference to a Comparative Example 1 in FIG. 5. FIG. 5 is a cross-sectional view of the Comparative Example 1 along the direction perpendicular to the nozzle array direction (NAD).

In Comparative Example 1, a head 409 includes the temperature detector 50 in the common-chamber member 20.

Here, if the temperature of the liquid in the common chamber 10 is controlled by the temperature-control fluid that flows through the temperature-control channel 42 of the temperature-control channel member 41, the common-chamber member 20 and the temperature-control channel member 41 has to be formed of a material having a high thermal conductivity. However, if the common-chamber member 20 and the temperature-control channel member 41 are formed of a material having a high thermal conductivity, the temperature detector 50 of the Comparative Example 1 detects the temperature of the common-chamber member 20 and the temperature-control channel member 41 instead of detecting the temperature of the liquid in the common chamber 10.

The configuration of the head 409 in the Comparative Example 1 can stabilize the temperature of the liquid to a certain extent. However, the accuracy of detection of the temperature of the liquid is degraded so that the temperature of the liquid may not be detected accurately. In particular, a problem may occur in which a large deviation occurs between a temperature detected by the temperature detector 50 and an actual temperature of the liquid in the individual chamber 6 when the temperature of the liquid in the nozzles 4 is increased due to heat generated by driving the head 409 and radiant heat transferred from a printing medium, for example.

Therefore, the head 404A in the present embodiment includes the temperature detector 50 for detecting the temperature of the liquid disposed opposite the common chamber 10 across the individual chamber 6 in the direction perpendicular to the liquid discharge direction D1 (in the liquid flow direction D2). Thus, the head 404A according to the present embodiment can be protected from the influence of the temperature change of the temperature controller and can accurately detect the temperature of the liquid in the individual chamber 6.

Since the temperature-control channel 42 is disposed at a position (portion) that is thermally separated from the temperature detector 50 across the individual chamber 6, the temperature detector 50 can accurately detect the temperature of the liquid in the individual chamber 6 without influence of the temperature of the temperature-control fluid in the temperature-control channel 42.

Further, since the temperature detector 50 is thermally separated from the temperature-control channel 42 across the individual chamber 6, the accuracy of the temperature detection of the temperature detector 50 is not affected even if the temperature-control channel member 41 and the common-chamber member 20 that is a frame member are formed of a metal having a high thermal conductivity. Thus, the temperature-control channel member 41 and the common-chamber member 20 can be formed of a metal member having high thermal conductivity to improve a function of controlling the liquid temperature. Thus, the head 404A can stably discharge the liquid from the nozzles 4.

Further, the common-chamber member 20 and the temperature-control channel member 41 can be covered with a cover having lower thermal conductivity than the common-chamber member 20 and the temperature-control channel member 41. The common-chamber member 20 and the temperature-control channel member 41 become the frame member. Thus, the head 404A can reduce the influence of the thermal environment outside the head 404A. Further, the function of adjusting the liquid temperature of the head 404A can be enhanced.

Further, the change in the viscosity of the liquid among the change in the physical property of the liquid due to temperature change affects the discharge function of the head 404A. Thus, the present embodiment is particularly effective when using a liquid, the viscosity of which changes with the temperature change. As an ink, a viscosity of which changes according to a change in temperature, there is a liquid such as ink enhanced in fixing function including a resin component of a polymer, for example.

Figure 6:
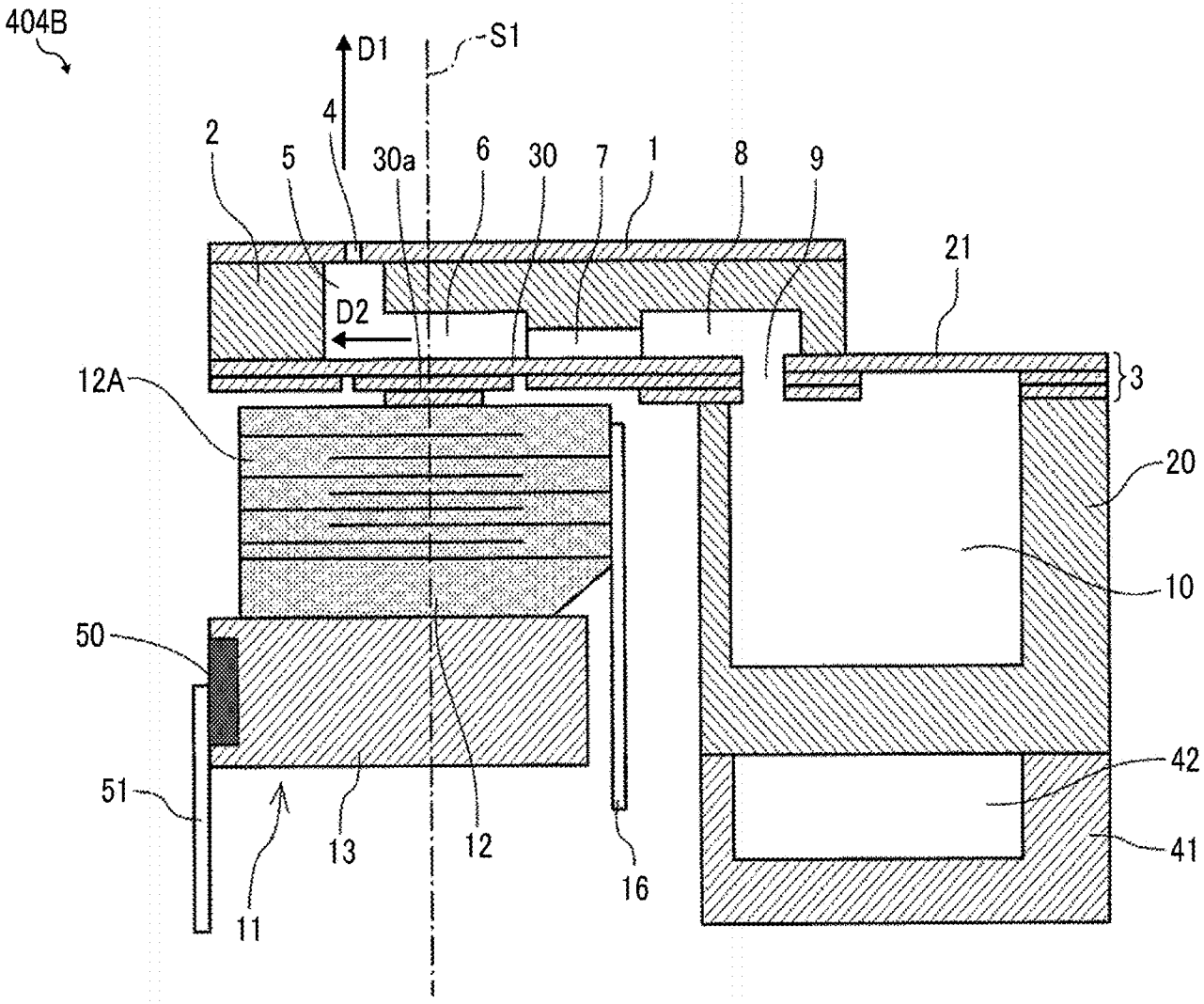
FIG. 6 is a cross-sectional view of the liquid discharge head according to a second embodiment of the present disclosure, in the direction perpendicular to the nozzle array direction.

Next, a second embodiment of the present disclosure is described with reference to FIG. 6. FIG. 6 is a cross-sectional view of the head 404B according to the second embodiment of the present disclosure, in the direction perpendicular to the nozzle array direction (NAD).

In the present embodiment, the temperature detector 50 is provided on the base 13 of the piezoelectric actuator 11 serving as the pressure generator. Also in the present embodiment, the temperature detector 50 for detecting the temperature of the liquid is disposed in the vicinity of the individual chamber 6 and opposite the common chamber 10 across the individual chamber 6 (across the line S1), so that the temperature detector 50 and the common chamber 10 sandwiches the individual chamber 6 in the direction perpendicular to the liquid discharge direction D1 (in the liquid flow direction D2).

Even in such a configuration in FIG. 6, the temperature detector 50 is disposed at a position (portion) thermally separated from the temperature-control channel 42 across the individual chamber 6. Thus, the head 404B according to the second embodiment can accurately detect the liquid temperature without being affected by the temperature of the temperature-control fluid in the temperature-control channel 42. Thus, the head 404B according to the second embodiment can obtain stable discharge characteristics.

Figure 7:
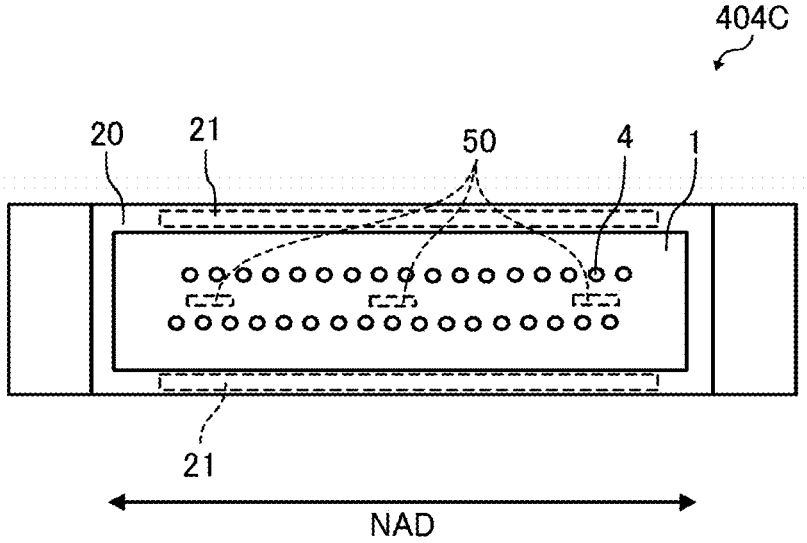
FIG. 7 is a plan view of the liquid discharge head according to a third embodiment of the present disclosure.

Next, a third embodiment of the present disclosure is described with reference to FIG. 7. FIG. 7 is a plan view of the head 404C according to the third embodiment of the present disclosure.

The head 404C according to the present embodiment includes a plurality of temperature detectors 50 arranged along the nozzle array direction NAD. The number of the temperature detectors is three in this example. However, the head 404C may include two, four, or more temperature detectors 50.

Thus, the head 404C can further accurately detect the liquid temperature with such a configuration as illustrated in FIG. 7.

In each of the above-described embodiments, the present embodiment is applied to the side shooter type of the heads 404A to 404C. However, the present embodiment can also be applied to an edge shooter type of the head. In the edge shooter type of the head, the temperature detector 50 is preferably disposed opposite the common chamber 10 with the individual chamber 6 interposed between the temperature detector 50 and the common chamber 10 in the liquid discharge direction D1.

Figure 8:
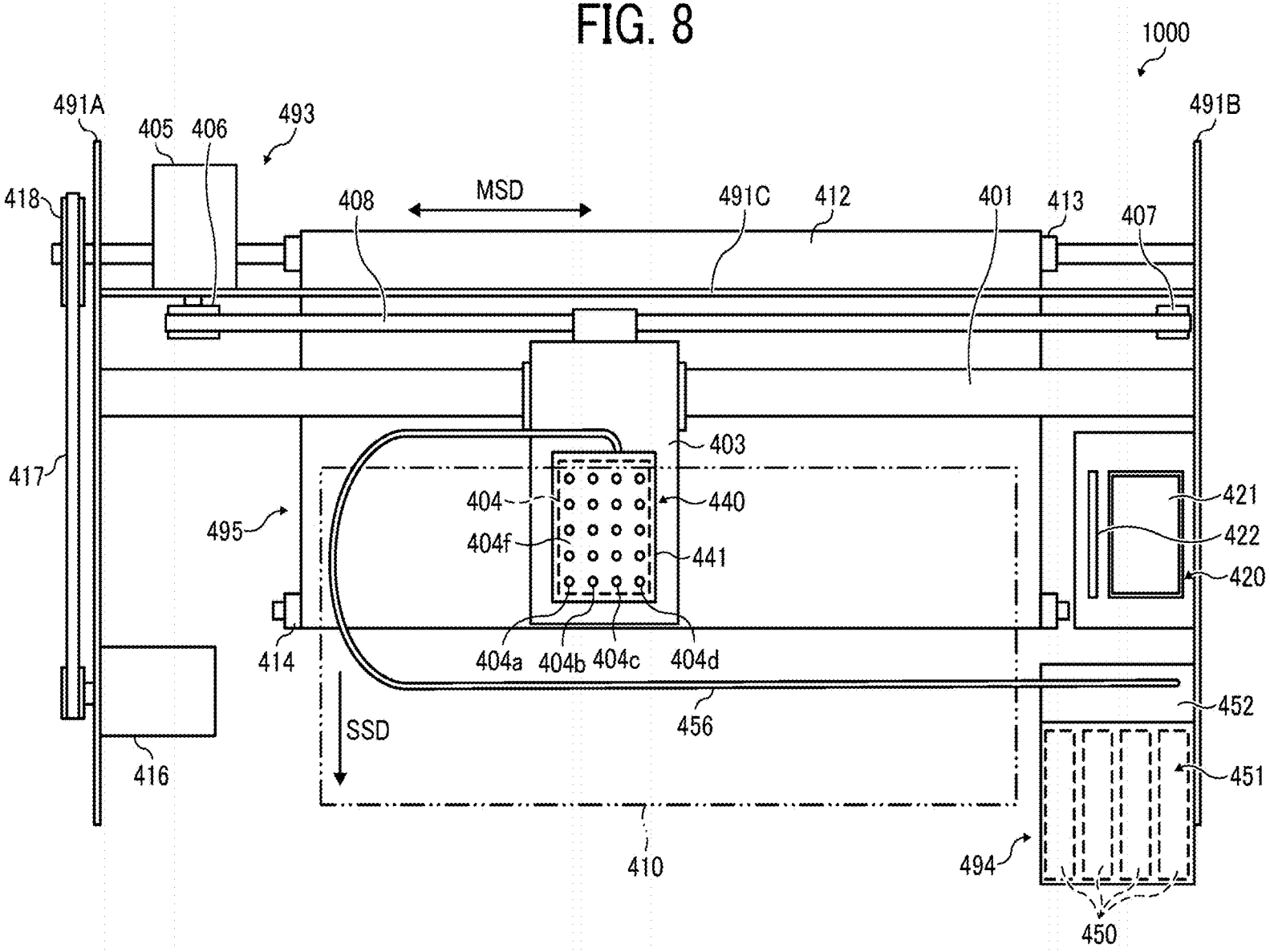
FIG. 8 is a plan view of a portion of a liquid discharge apparatus according to the present disclosure.
Figure 9:
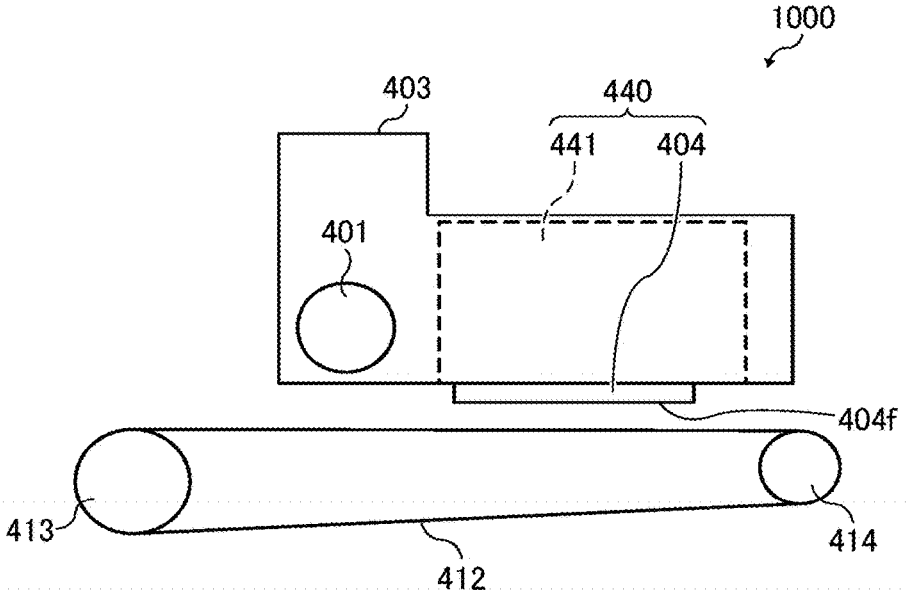
FIG. 9 is a side view of a portion of the liquid discharge apparatus.

Next, a liquid discharge apparatus 1000 according to an embodiment of the present disclosure is described with reference to FIGS. 8 and 9. FIG. 8 is a plan view of a portion of the liquid discharge apparatus 1000. FIG. 9 is a side view of a portion of the liquid discharge apparatus 1000 of FIG. 8.

A liquid discharge apparatus 1000 according to the present embodiment is a serial-type apparatus in which a main scan moving unit 493 reciprocally moves a carriage 403 in a main scanning direction indicated by arrow MSD in FIG. 8. The main scan moving unit 493 includes a guide 401, a main scanning motor 405, and a timing belt 408, for example. The guide 401 is bridged between a left side plate 491A and a right-side plate 491B that movably holds the carriage 403. The main scanning motor 405 serving as a drive unit to reciprocally move the carriage 403 in the main scanning direction MSD via the timing belt 408 bridged between a driving pulley 406 and a driven pulley 407.

The carriage 403 mounts a liquid discharge device 440 in which a head 404 according to the present embodiment and a head tank 441 form a single unit. The head 404 of the liquid discharge device 440 discharges liquid of each color, for example, yellow (Y), cyan (C), magenta (M), and black (K). The head 404 includes nozzle arrays 404*a*, 404*b*, 404*c*, and 404*d*, each including a plurality of nozzles 4 arrayed in row in a sub-scanning direction, which is indicated by arrow SSD in FIG. 8, perpendicular to the main scanning direction MSD. The head 404 is mounted to the carriage 403 in such a way that ink droplets are discharged downward.

The liquid stored in liquid cartridges 450 are supplied to the head tank 441 by a supply unit 494 for supplying the liquid stored outside the head 404 to the head 404.

The supply unit 494 includes a cartridge holder 451 which is a filling section for mounting the liquid cartridges 450, a tube 456, a liquid feed unit 452 including a liquid feed pump, and the like. The liquid cartridges 450 are detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyance means and a sub-scanning motor 416 for driving a conveyance belt 412.

The conveyance belt 412 attracts the sheet 410 and conveys the sheet 410 at a position facing the head 404. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the head 404 in good condition is disposed on a lateral side of the conveyance belt 412.

The maintenance unit 420 includes, for example, a cap 421 to cap a nozzle face 404*f* (i.e., a face on which the nozzles 4 are formed) of the head 404 and a wiper 422 to wipe the nozzle face 404*f*.

The main scan moving unit 493, the supply unit 494, the maintenance unit 420, and the conveyance unit 495 are mounted to a housing that includes the left side plate 491A, the right-side plate 491B, and a rear-side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the head 404 according to an embodiment of the present disclosure, thus allowing stable formation of high quality images.

Figure 10:
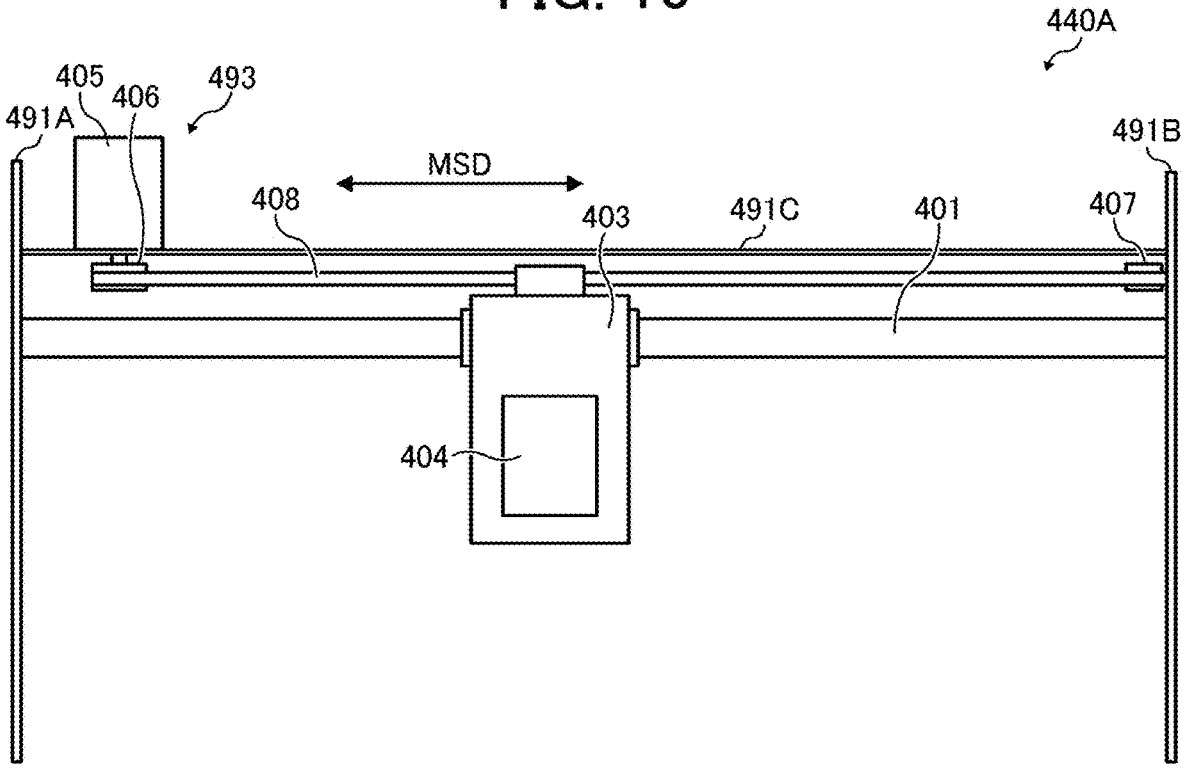
FIG. 10 is a plan view of a portion of another example of the liquid discharge device.

Next, another example of the liquid discharge device according to the present embodiment is described with reference to FIG. 10. FIG. 10 is a plan view of a portion of another example of a liquid discharge device 440A.

The liquid discharge device 440A includes the housing, the main scan moving unit 493, the carriage 403, and the head 404 among components of the liquid discharge apparatus 1000. The left side plate 491A, the right-side plate 491B, and the rear-side plate 491C constitute the housing.

Note that, in the liquid discharge device 440A, at least one of the maintenance unit 420 and the supply unit 494 described above may be mounted on, for example, the right-side plate 491B.

Figure 11:
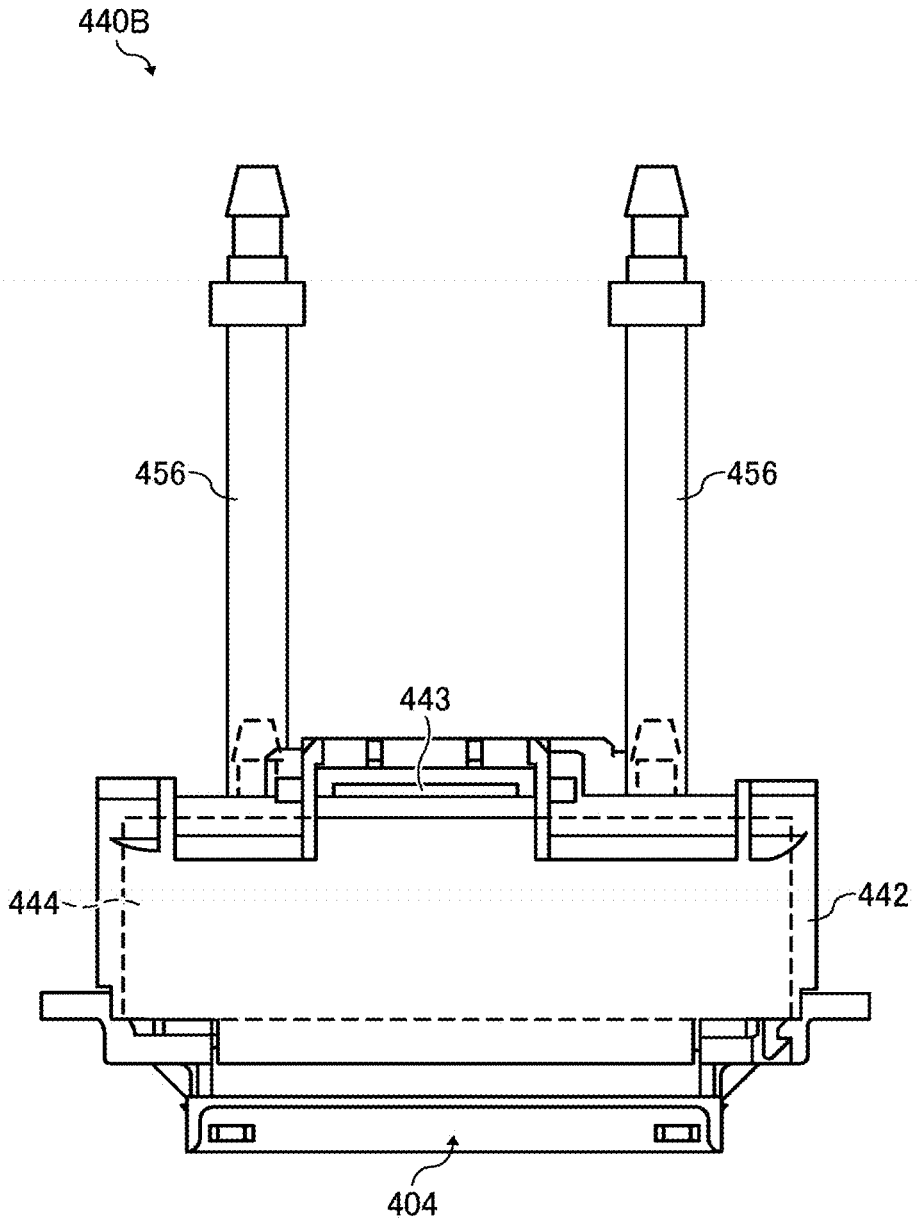
FIG. 11 is a front view of the liquid discharge device according to still another embodiment of the present disclosure.

Next, still another example of the liquid discharge device according to an embodiment of the present disclosure is described with reference to FIG. 11. FIG. 11 is a front view of still another example of a liquid discharge device 440B.

The liquid discharge device 440B includes the head 404 to which a channel part 444 is mounted and a tube 456 connected to the channel part 444.

Further, the channel part 444 is disposed inside a cover 442. Instead of the channel part 444, the liquid discharge device 440B may include the head tank 441. A connector 443 for electrical connection with the head 404 is provided on an upper part of the channel part 444.

In the above-described embodiments, discharged liquid is not limited to any particular liquid as long as the liquid has a viscosity or surface tension that allows it to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The "liquid discharge device" is an integrated unit including the head and a functional part(s) or unit(s) and is an assembly of parts relating to liquid discharge. For example, the "liquid discharge device" includes a combination of the head with at least one of a head tank, a carriage, a supply unit, a maintenance unit, and a main scan moving unit.

Examples of the integrated unit include a combination in which the liquid discharge head and one or more functional parts and devices are secured to each other through, e.g., fastening, bonding, or engaging, and a combination in which one of the head and the functional parts and devices is movably held by another. Further, the head, the functional parts, and the mechanism may be configured to be detachable from each other.

For example, the head and the head tank are integrated as the liquid discharge device. Alternatively, the head may be coupled with the head tank through a tube or the like to integrally form the liquid discharge device. A unit including a filter may be added at a position between the head tank and the head of the liquid discharge device.

As another example, the liquid discharge device is an integrated unit in which the head and the carriage form a single unit.

In still another example, the liquid discharge device includes the liquid discharge head movably held by a guide that forms part of a main-scanning moving unit, so that the liquid discharge head and the main-scanning moving unit form a single unit. The liquid discharge device may include the head, the carriage, and the main scan moving unit that form a single unit.

In still another example, the cap that forms part of the maintenance unit is secured to the carriage mounting the liquid discharge head so that the liquid discharge head, the carriage, and the maintenance unit form a single unit to form the liquid discharge device.

Further, in still another example, the liquid discharge device includes tubes connected to the head tank or the head mounting the channel member so that the head and the supply unit form a single unit. Through this tube, the liquid of the liquid storage source such as an ink cartridge is supplied to the head.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material on which liquid adheres" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material to which liquid adheres" may be any material as long as liquid can temporarily adhere such as paper, thread, fiber, cloth, leather, metal, plastic, glass, wood, ceramics, or the like.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a plurality of individual chambers communicating with a plurality of nozzles that discharges a liquid;

a nozzle plate that forms the plurality of nozzles;

a common chamber formed by a frame and communicating with the plurality of individual chambers:

a channel plate that forms each of the plurality of individual chambers;

a temperature detector to detect a temperature of the liquid; and a temperature controller connected to the temperature detector, to heat or cool the liquid in the common chamber based on readings from the temperature detector, wherein the temperature detector is disposed opposite the common chamber across each of the plurality of individual chambers such that all of the plurality of individual chambers are located between the common chamber and the temperature detector in a direction perpendicular to a direction of liquid discharged from the plurality of nozzles, wherein the channel plate is disposed immediately adjacent to the nozzle plate, and wherein the temperature detector is disposed in the channel plate in a vicinity of the plurality of individual chambers.

2. The liquid discharge head according to claim 1, further comprising a pressure generator to generate a pressure to pressurize the liquid in the plurality of individual chambers, wherein the temperature detector is disposed on the pressure generator.

3. The liquid discharge head according to claim 2, wherein the pressure generator comprises:

a plurality of piezoelectric elements to pressurize the liquid in the plurality of individual chambers, respectively; and a base on which the plurality of piezoelectric elements is disposed, wherein the temperature detector is disposed on the base.

4. The liquid discharge head according to claim 1, further comprising a temperature-control channel through which a temperature-control fluid flows, wherein the temperature-control channel is disposed adjacent to the common chamber.

5. The liquid discharge head according to claim 1, wherein the frame forming the common chamber is made of metal.

6. A liquid discharge device comprising the liquid discharge head according to claim 1.

7. The liquid discharge device according to claim 6, further comprising at least one of:

a head tank to store the liquid to be supplied to the liquid discharge head;

a carriage to mount the liquid discharge head;

a supply unit to supply the liquid to the liquid discharge head;

a maintenance unit to maintain the liquid discharge head; and a chive unit to move the carriage in a main scanning direction, the drive unit and the liquid discharge head forming a single unit.

8. A liquid discharge apparatus comprising the liquid discharge head according to claim 1.

9. A liquid discharge apparatus comprising the liquid discharge device according to claim 6.

10. A liquid discharge head, comprising:

a plurality of individual chambers communicating with a plurality of nozzles that discharges a liquid;

a common chamber formed by a frame and communicating with the plurality of individual chambers;

a channel plate that forms each of the plurality of individual chambers;

a nozzle plate that forms the plurality of nozzles;

a temperature detector to detect a temperature of the liquid; and a temperature controller connected to the temperature detector, to heat or cool the liquid in the common chamber based on readings from the temperature detector, wherein the temperature detector is disposed opposite the common chamber across each of the plurality of individual chambers such that all of the plurality of individual chambers are located between the common chamber and the temperature detector in a direction perpendicular to a direction of liquid discharged from the plurality of nozzles, wherein the channel plate is disposed immediately adjacent to the nozzle plate, wherein the temperature detector is disposed in a wall portion of the channel plate, and wherein the wall portion of the channel plate that includes the temperature detector, forms a side wall surface of the plurality of individual chambers.

* * * * *